US006443142B1

(12) United States Patent
Wiseby et al.

(10) Patent No.: US 6,443,142 B1
(45) Date of Patent: Sep. 3, 2002

(54) DEVICE FOR A SIGHT

(75) Inventors: Dennis Wiseby; Tony Wiseby, both of Svenljunga (SE)

(73) Assignee: Detowis AB, Svenljunga (SE)

( * ) Notice: Subject to any disclaimer, the term of this patent is extended or adjusted under 35 U.S.C. 154(b) by 0 days.

(21) Appl. No.: 09/475,624

(22) Filed: Dec. 30, 1999

Related U.S. Application Data

(63) Continuation-in-part of application No. 09/227,796, filed on Jan. 8, 1999, now Pat. No. 6,026,799.

(30) Foreign Application Priority Data

Jan. 8, 1998 (SE) ..... 9800028

(51) Int. Cl.[7] ..... F41G 1/467
(52) U.S. Cl. ..... 124/87; 33/265
(58) Field of Search ..... 33/265; 124/87

(56) References Cited

U.S. PATENT DOCUMENTS 3,787,984 A * 1/1974 Bear et al. ..... 33/265
3,854,217 A * 12/1974 Killian ..... 33/265
4,317,288 A * 3/1982 Yasui ..... 33/265
4,567,668 A * 2/1986 King et al. ..... 33/265
4,986,001 A * 1/1991 Giamattei ..... 33/265
5,285,767 A * 2/1994 Padilla ..... 124/87
5,384,966 A * 1/1995 Gibbs ..... 33/265
5,414,936 A * 5/1995 Sappington ..... 33/265
5,507,272 A * 4/1996 Scantlen ..... 124/87
5,509,402 A * 4/1996 Sappington ..... 124/87
5,524,601 A * 6/1996 Slates et al. ..... 124/87
5,657,740 A * 8/1997 Slates et al. ..... 124/87
5,735,053 A * 4/1998 NcGunigal ..... 33/265
5,941,226 A * 8/1999 Marietta ..... 124/87

* cited by examiner

*Primary Examiner*—John A. Ricci
(74) *Attorney, Agent, or Firm*—Orum & Roth

(57) ABSTRACT

A sight device for an archery bow comprises a sight arm adjustably attached to the bow. A support for a lens is secured to the sight arm. The support is vertically adjustable. The support includes a horizontally adjustable arm and two attachment lugs (45, 46). The attachment lugs are compressible to hold the lens.

5 Claims, 8 Drawing Sheets

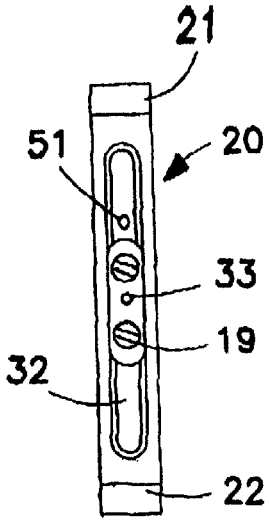
FIG. 7
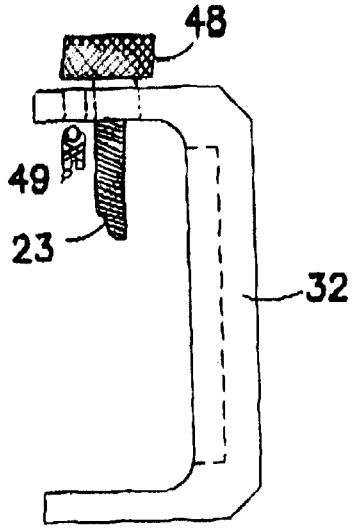
FIG. 8
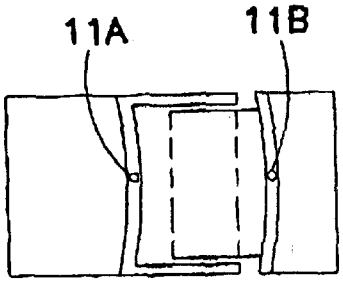
FIG. 9
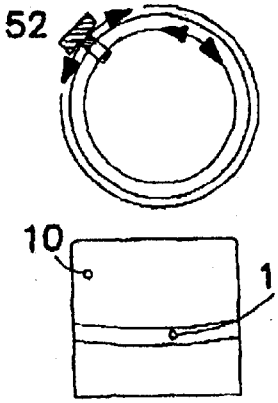
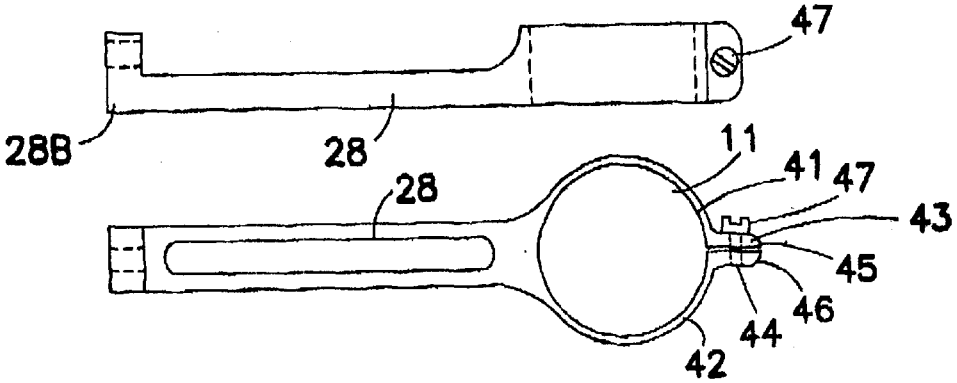

DEVICE FOR A SIGHT

This is a continuation-in-part of application(s) U.S. Ser. No.(s) 09/227,796 filed on Jan. 8, 1999 now U.S. Pat. No. 6,026,799.

The present invention relates to a device for a sight for a bow consisting of a sight arm capable of connection to an attachment plate attachable to the bow, which arm has means for the angular adjustment of the sight in the lateral sense and a lateral adjustment unit and a holder for a scope sight lens attachable thereto.

A scope sight previously disclosed through U.S. Pat. No. 5,509,402, for example, comprises a threaded shaft to which the sight is secured. This means that this shaft is bent when it is wished to adjust the scope, causing the shaft to break off as a result. U.S. Pat. No. 5,507,272 presents a sight in which a supporting shaft is clamped securely to the free end of a sight arm. Adjustment in the lateral sense is not easy, however, with this previously disclosed sight. U.S. Pat. No. 5,524,601 presents an adjustable sight with a simple threaded rod and a locking means capable of removal together with it and capable of actuation for the adjustment of the sight in the longitudinal sense, but not in the vertical sense.

The principal object of the present invention is, in the first instance, to make available a sight device which permits simple adjustment of the various parts of the sight to be achieved.

The aforementioned object is achieved by means of a device in accordance with the present invention, which is characterized essentially in that the attachment plate exhibits a number of vertically arranged grooves, in which matching longitudinal grooves on the sight arm are capable of being accommodated at the desired level, with the attachment arm and the attachment plate being capable of being screwed securely to one another, in that the sight arm exhibits an articulated shaft extending vertically in the form of a cylinder, which, when in its set angled position, a holder is so arranged as to grip and clamp securely, in that the lateral adjustment unit is adjustably attached in the vertical sense by means of screws capable of being accommodated in grooves, which screws can be screwed into the holder in the desired vertical position, and in that the scope sight attachment can be split and clamped together for the purpose of securing a lens therein.

BRIEF DESCRIPTION OF THE DRAWINGS

The invention is described below with reference to the accompanying drawings, in which:

FIG. 7 shows the part of the sight device viewed from the front;

FIG. 8 shows a detail of the vertical adjustment of the sight;

FIG. 9 shows a scope sight lens holder viewed from different directions;

DETAILED DESCRIPTION OF THE INVENTION

Figure 1:
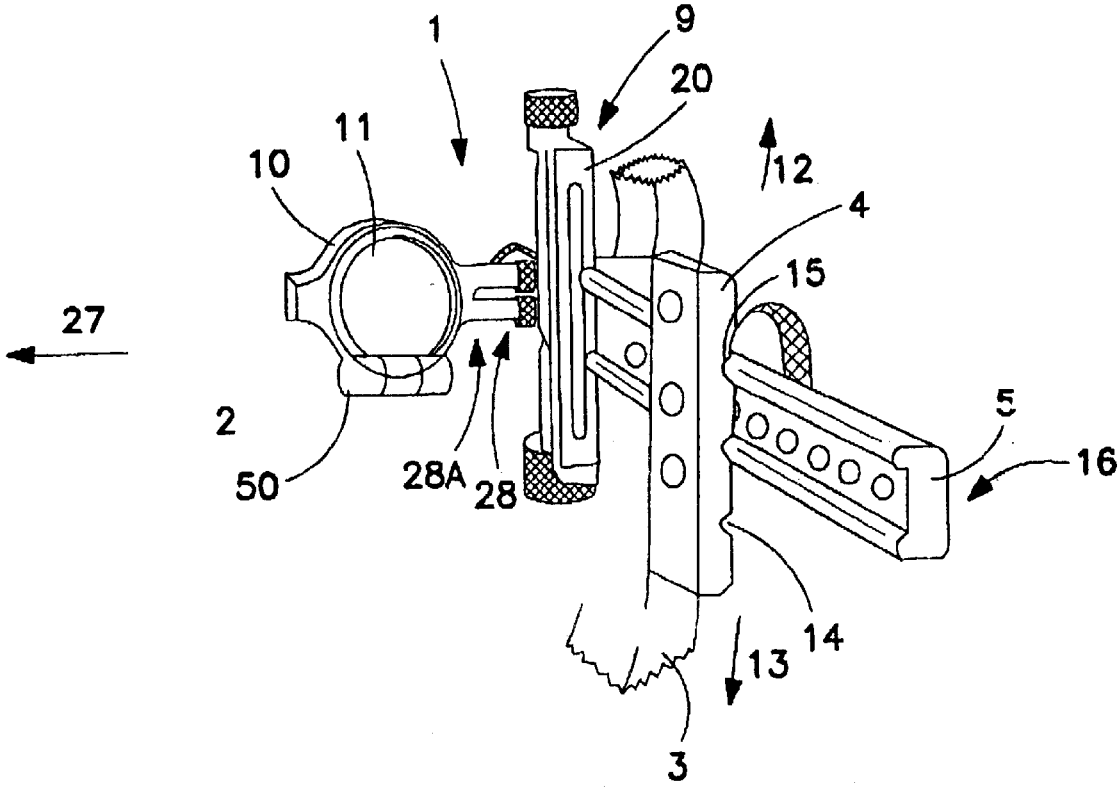
FIG. 1 shows a perspective view of a sight device viewed at an angle from the rear.
Figure 2:
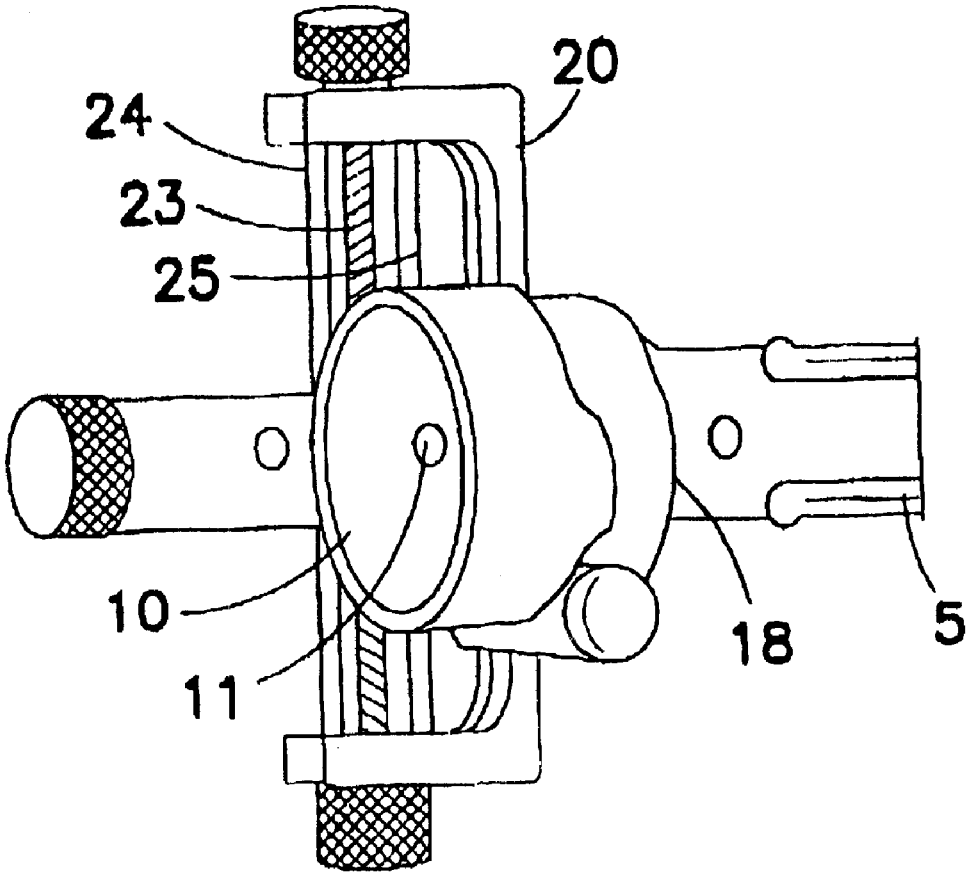
FIG. 2 shows the sight device viewed at an angle from the front.

A device 1 in accordance with the present invention for a sight 2 for a bow 3 consists of a sight arm 5 capable of connection to an attachment plate 4 attachable to the bow 3 by means of a screw, which arm has means 6 for the angular adjustment of the sight 2 in the lateral sense 7, 8 and a lateral adjustment unit 9 and a holder 10 for a scope sight lens 11 attachable thereto. In accordance with the invention, the attachment plate 4 exhibits a number of vertically 12, 13 arranged grooves 14, in which two matching and longitudinally thickened grooves 15 on the sight arm 5 are capable of being accommodated at the desired level 16, with the attachment arm 5 and the attachment plate 4 being capable of being screwed securely to one another.

The sight arm 5 exhibits a cylindrical articulated shaft 17, which extends vertically 12, 13, and which, when in its set angled position, a holder 18 is so arranged as to grip and clamp securely.

The lateral adjustment unit 9 is attached so that it is adjustable in the vertical sense 12, 13 by means of screws 19 capable of being accommodated in grooves 51, which screws can be screwed into the holder 18 in the desired vertical position.

The aforementioned scope sight lens holder 10 can be split and clamped together for the purpose of securing a lens 11 therein.

The aforementioned lateral adjustment unit 9 is formed by a U-shaped yoke 20, which is provided with a threaded rod 23 and guides 24, 25 extending between its legs 21, 22 for the purpose of supporting a sight holder 26 capable of adjustment to the desired vertical position along them, from which sight holder a laterally 27 extending adjustable arm 28 is arranged for supporting the scope sight lens holder 10 at its one end 28A.

The aforementioned lateral adjustment arm 28 can be clamped securely between the sight holder 26 and a tightening arrangement 29, preferably a screw 25 capable of being screwed into the sight holder 26, and carried a threaded shaft 31 extending all the way through a threaded hole in the sight holder 26 in an angled part 30 at its end 28B facing away from the scope lens holder 10.

A vertical groove 51 extends through the base part 32 of the U-shaped yoke, and a laterally enlarged locking part 33, preferably an elongated locking part in the form of a washer with two screw holes 3, is capable of being accommodated so that it is capable of displacement on one side of the groove.

The aforementioned holder 18 exhibits a vertical, cylindrical accommodating space 34, which is intended to accommodate the articulated shaft 17, and has pairs of shaped clamping arms 35, 36 extending from it, through which holes 37, 38 extend for the purpose of accommodating a clamping screw 39 or some other locking device, which extends through a hole 40 in the enclosed end 5A of the sight arm 5.

The aforementioned arm 28, which is intended to support a scope sight lens 11, is formed inter alia by a two-part cylindrical lens accommodating part 41, 42 on the intended holder 10 of the arm. Attachment lugs 45, 46 provided with screw holes 43, 44, which are situated at the free ends of the accommodating parts, are capable of being clamped together by means of a clamping screw 47 that can be screwed in to reduce the effective width of the lens accommodating part, thereby clamping a lens securely in the housing.

The aforementioned threaded rod 23, which is provided for the vertical adjustment of the sight holder 26, is attached to a knob 48, by means of which a spring-actuated ball 49 of some other locking body is so arranged as to interact with a recess in the knob 48 to provide click adjustment in conjunction with the vertical setting of the sight unit.

A level 50 is supported by the lateral adjustment unit 9 to enable the bow to be aligned correctly when it is wished to shoot it.

The function of the various components is summarized below with reference to the Figures:

FIG. 1: The attachment plate 4 for the sight arm 5 has three V-section milled grooves 14, and the sight arm 5 has two V-section milled profiles 15, which run in the grooves 14. The sight arm can be set to three different heights. This pressure socket provides engagement of the sight that is 100% identical every time the sight is assembled.

Figure 3:
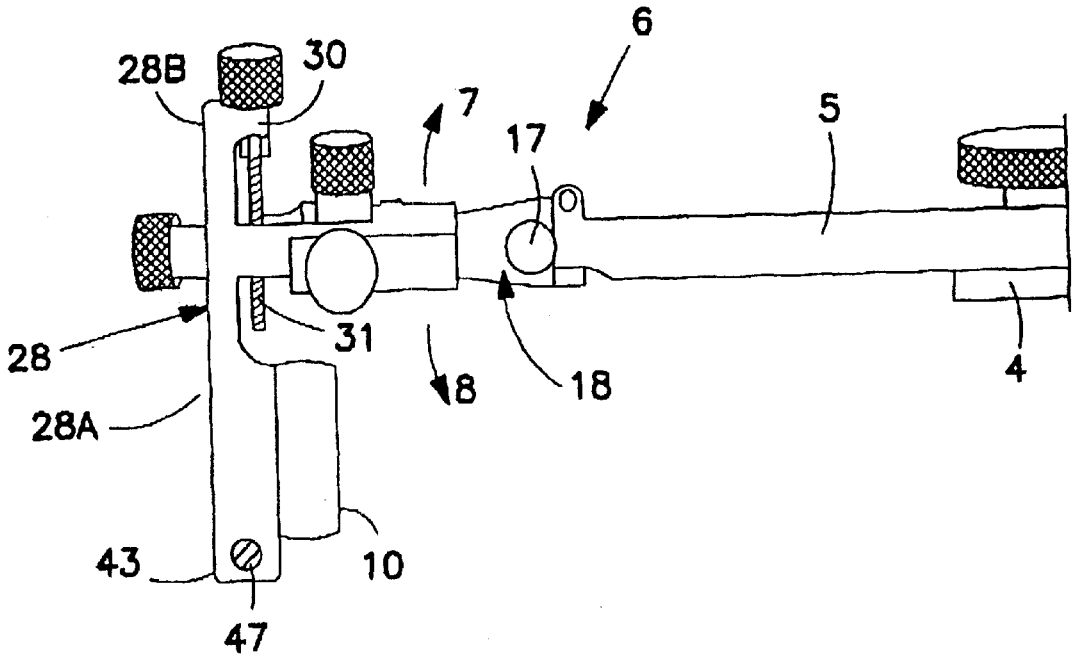
FIG. 3 shows the sight device viewed from above.
Figure 4:
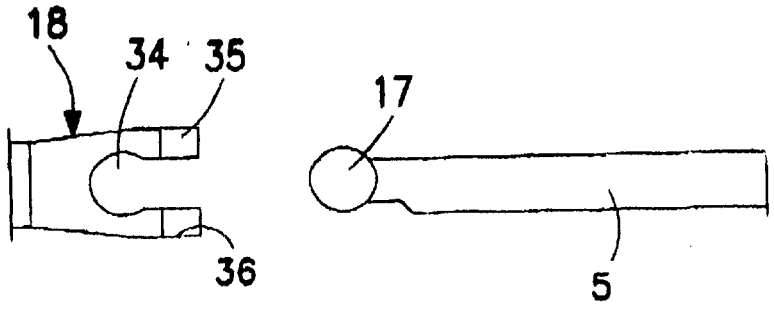
FIG. 4 shows a partial view of a clamping component in the sight device.

FIG. 3: The sight arm 5 has angular adjustment 6 in the lateral sense 7, 8 of the sight which is of a new type, which engages around a round bar 17 and provides very secure locking.

Figure 11:
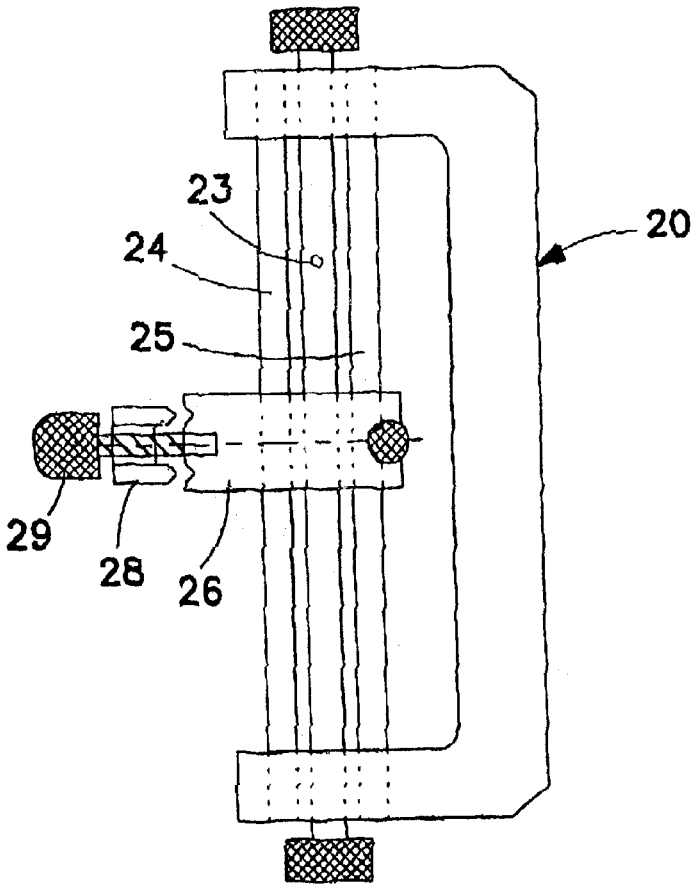
FIG. 11 shows the holder in the installed position on the part of the sight device.

FIGS. 3 and 11: The sight has a lateral adjustment that is installed from the front on the sight yoke and against the lateral adjustment on the sight arm. Present-day sights have this adjustment from the opposite direction, i.e. from the rear.

Figure 5:
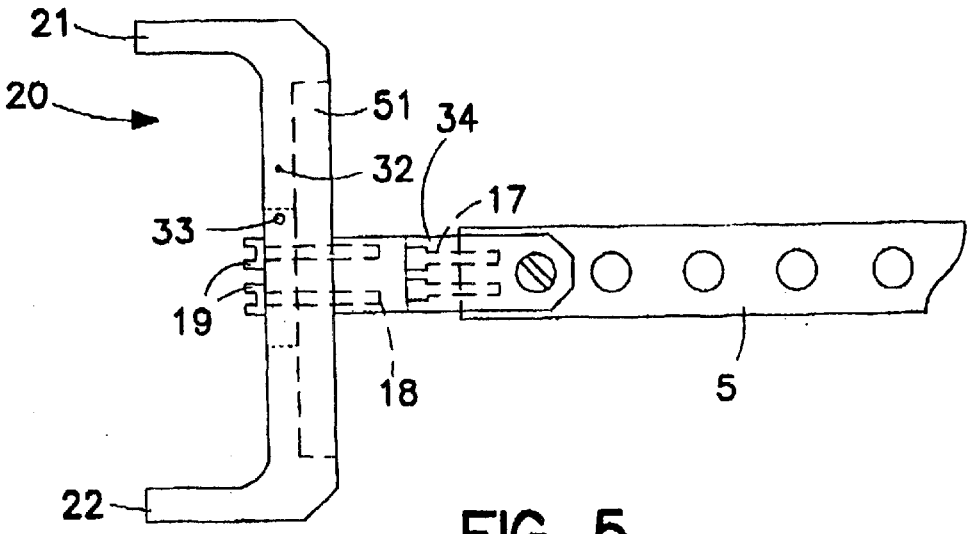
FIG. 5 and 6 show part of the sight device viewed from the side and from above.
Figure 6:
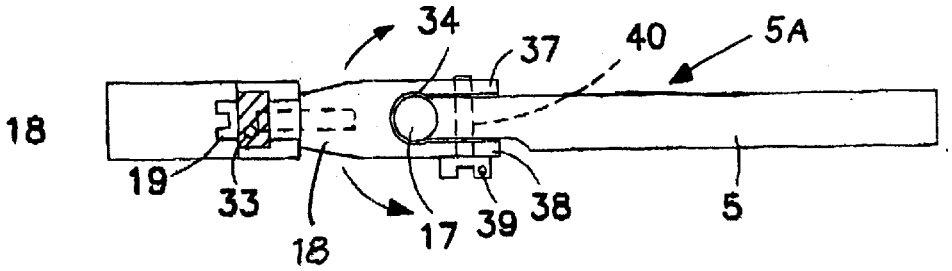

FIGS. 5–7: Our adjustment includes the possibility of adjusting the entire sight unit vertically up and down and steplessly in the milled groove on the sight yoke. Present-day sights are adjusted in this way from the rear side in fixed positions by moving the sight arm and locking it to the sight in pre-drilled holes arranged at different relative distances.

Figure 12:
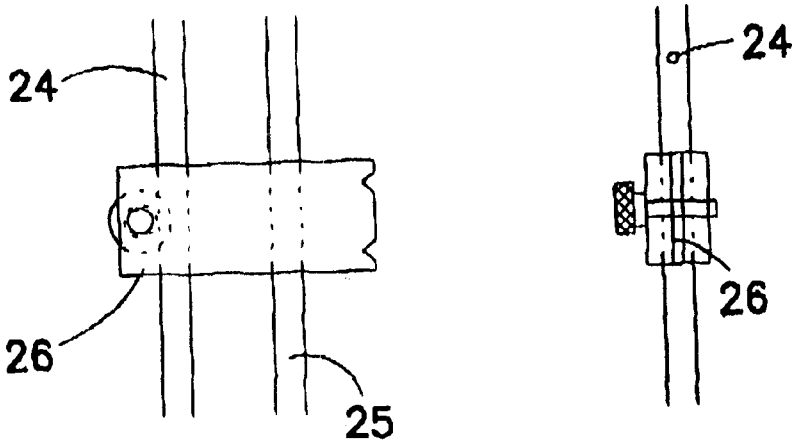
FIG. 12 shows a means for locking a sight unit on a guide.
Figure 13:
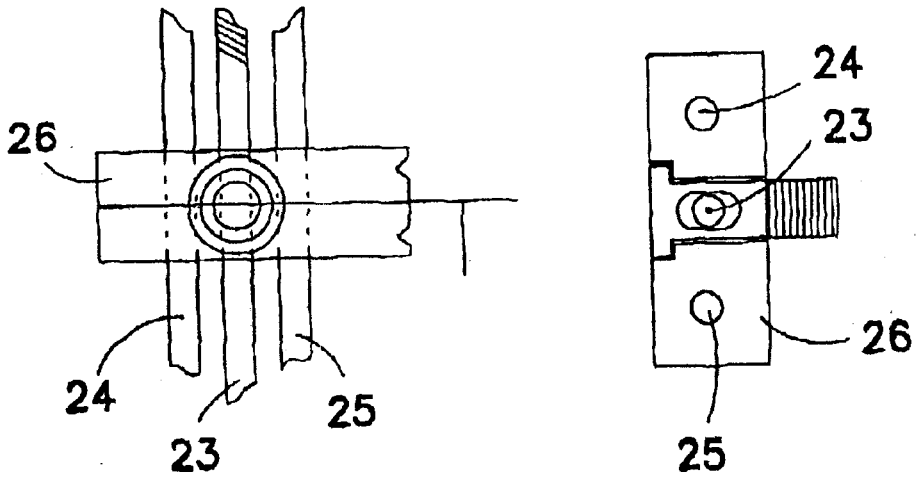
FIG. 13 shows a locking device acting against a lead screw.

FIGS. 11–13: The adjustment for the sight unit runs in two guides. This means that the adjustment follows a precise path as adjustment is made. A threaded rod is located between these two guides. This enables the sighting point to be adjusted vertically upwards and downwards by slackening the knob by a quarter of a turn, thereby releasing the locking function that also takes place when it is tightened. Once the knob has been slackened by a quarter of a turn, adjustment is possible by rotating the knobs that are present on the sight unit on the top side and bottom side of the sight yoke. If it is wished to adjust over a greater distance in a single move, the knob is slackened by further 1½ turns, whereupon the knob is pushed in to release the part that is in contact with the threaded rod, which permits the adjustment device to be slid as far as desired. Once the adjustment has been made, the knob is retightened and becomes securely locked against the threaded rod. As additional security, we have a locking screw that locks against the innermost guide. Today's sights do not lock against the threaded rod and do not lock against any guide.

Figure 10:
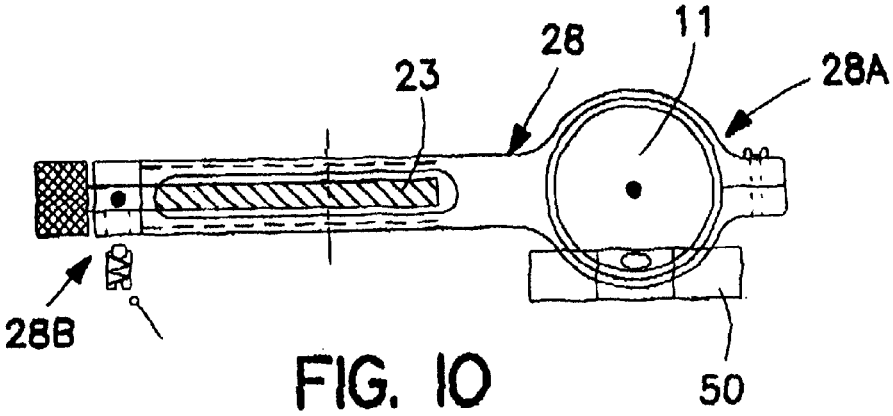
FIG. 10 shows the holder viewed from the front.

FIGS. 9–11: The lateral adjustment means that is installed on the sight unit is manufactured as a single unit. The scope and a sight pin, if any, are located on this. This lateral adjustment means runs in two V-section milled profiles, which run in two V-section milled grooves on the sight unit. This functions in the same way as the attachment of the sight arm to the sight plate in the first paragraph. The lateral adjustment can be adjusted after slackening the locking screw and rotating the lateral adjustment knob on the side. The scope (magnifying lens) is attached directly to the lateral adjustment unit, which has an outer ring with a locking screw on the side. The scope is pushed into this ring, where it can be adjusted by rotating it to the desired position and then locking it securely. Previously disclosed sights are not manufactured in this way with a whole lateral adjustment unit, and the scope itself can be adjusted individually directly in the lateral adjustment unit. The sights that are available today are secured to a threaded shaft, which is then secured to the sight. This means that this shaft is bent in order to adjust the scope, with the result that the shaft pulled off. Our adjustment of the scope, together with the fact that the lateral adjustment unit is manufactured in a single piece, means that this problem is avoided.

FIG. 9: The scope 11 is a separate unit and is thus easy to replace, if the need arises, without having to disturb the lateral adjustment. In the case of present-day sights, it is necessary to recalibrate the bow after having replaced the scope.

The present scope will also be supplied with two lenses, 11A, 11B, which are polarizing; i.e. it must be possible to make the lens darker or lighter, as desired, for example when shooting into the sun, picking up the sun in the scope and being blinded. It is possible in this case to rotate one of the lenses steplessly to make it darker or lighter, as required. A locking means 52 is provided to lock the rotation of the lenses to one another.

The invention is not restricted to the illustrative examples described above and shown in the drawings, but may be varied within the scope of the Patent Claims without departing from the idea of invention.

Figure 14:
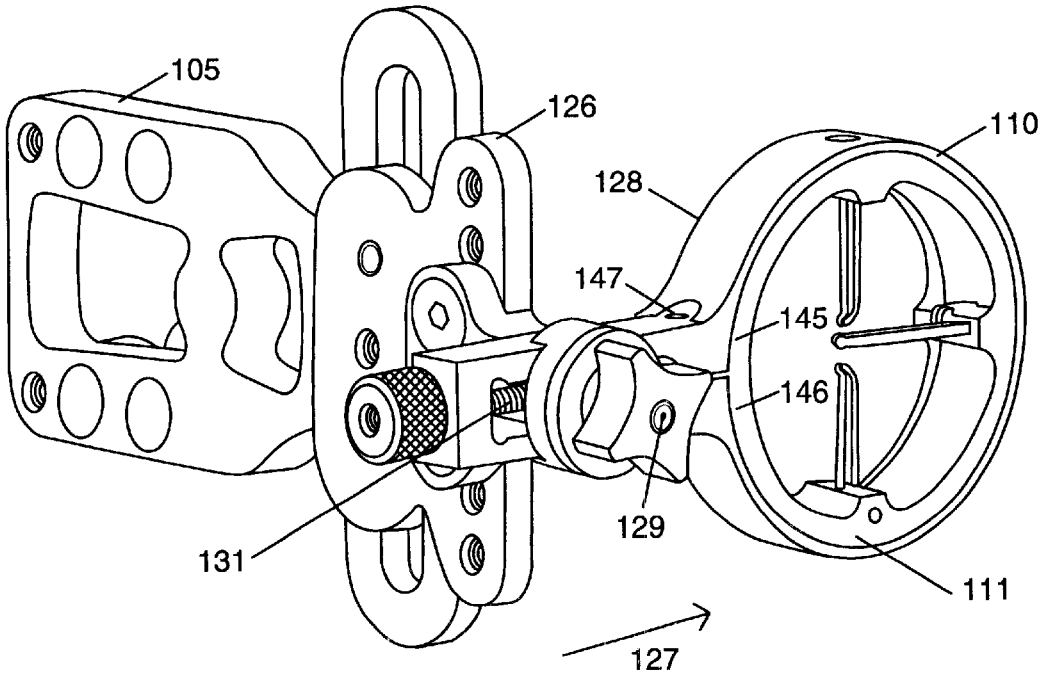
FIG. 14 shows a further sight device according to the invention.

FIG. 14 shows a further embodiment of a device 102 for a sight 111. A sight arm 105 having means for connecting the sight arm 105 to a bow. A sight holder 126 being adjustable to the sight arm 105 and a laterally 127 extending arm 128 for supporting a sight lens holder 110 being connected for lateral adjustment to said sight holder 126. By a screw 129 the arm is screwed into the sight holder 126. The sight holder 126 carries the threaded shaft 131.

By means of a clamping screw 147 the two clamping lugs 145, 146 are clamped together. The effective width of the lens accommodating part thereby clamping a lens 111 securely in the housing 110.

What is claimed is:

1. A sight device for a bow comprising:

a sight arm having means for connecting the sight arm to the bow;

a holder adjustably secured to said sight arm and laterally adjustable with respect to said sight arm;

a support for a lens securely attached to said holder;

wherein a first end of said support for a lens includes an angled part incorporating a threaded hole and a screw having a long threaded shaft received into said threaded hole, said support for a lens includes a lens holder secured to a second end of said support for a lens, wherein said lens holder includes a two-piece cylindrical clamp having a first end and a second end including two attachment lugs, and wherein each lug includes an aligned hole for a clamping screw to secure said lugs together.

2. The device according to claim 1, wherein said holder further comprises a knob and a spring lockingly attaching said knob to said threaded rod.

3. The device according to claim 1 wherein a level is attached to said support for said lens.

4. The sight device according to claim 1 wherein said support for a lens includes a U-shaped yoke having a base, two legs, and a threaded rod and two guides extending between said legs.

5. A sight device for a bow comprising;

a sight arm having a vertical slot; the sight arm adapted to attach to a bow;

a sight holder attachable to the sight arm by a first screw inserted through the vertical slot; the sight holder having a plurality of holes;

a bracket attachable to the sight holder via a second screw in at least one of the plurality of holes;

a lateral extending arm attachable to the bracket by a third screw; the lateral extending arm having a first and a second end;

a threaded shaft screwed into the first end; the threaded shaft adjustable as a lateral movement stop for the lateral extending arm; the second end forming a circular sight holder with a pair of clamping lugs adapted to receive a clamping screw adjustable to hold a sight within the circular sight holder.

* * * * *